United States Patent [19]

Segmiller et al.

[11] 4,246,844

[45] Jan. 27, 1981

[54] METHOD OF FORMING HIGH FRAGMENTATION MORTAR SHELLS

[75] Inventors: Joseph M. Segmiller; Thomas E. Lewis, both of Modesto, Calif.

[73] Assignee: United States of America, Washington, D.C.

[21] Appl. No.: 973,638

[22] Filed: Dec. 14, 1978

[51] Int. Cl.[3] ..... F42B 13/48

[52] U.S. Cl. ..... 102/67; 29/1.2; 148/12 R; 148/12 F

[58] Field of Search ..... 102/56, 67, 49.1; 29/1.2, 1.21; 148/142-144, 139, 12 R, 12 F

[56] References Cited

U.S. PATENT DOCUMENTS

| | | | |
|---|---|---|---|
| 1,310,075 | 7/1919 | Hadfield et al. | 148/143 X |
| 1,407,254 | 2/1922 | Cox | 148/134 |
| 2,044,780 | 6/1936 | Hardigg | 102/67 |
| 2,183,502 | 12/1939 | Lefere | 102/67 |
| 3,513,038 | 5/1970 | Weil | 102/56 X |
| 3,547,032 | 12/1970 | Horvath, Jr. | 102/67 |
| 3,676,907 | 2/1966 | Magis | 102/56 X |
| 3,791,881 | 2/1974 | Hayes | 102/56 X |

OTHER PUBLICATIONS

*The Making, Shaping and Treating of Steel,* Edited by Harold McGannon, USS 8 Edition 1964, p. 1057.

*Physical Mettalurgy for Engineers,* by Clark and Varney, Van Nostrand Com. Inc., Sep. 1962, pp. 158 & 159.

*Primary Examiner*—Harold J. Tudor

*Attorney, Agent, or Firm*—Huebner & Worrel

[57] ABSTRACT

The method and product, for forming ordnance shells such as mortar shells and other explosive projectiles wherein the fragmenation count or shattering of the shell upon explosion is greatly increased over standard shells produced in a conventional manner.

The method includes special heat treatment of the shell or projectile during initial stages of its formation whereby the molecular structure of steel used is changed principally from lamellar to spheroidal.

5 Claims, 3 Drawing Figures

METHOD OF FORMING HIGH FRAGMENTATION MORTAR SHELLS

BACKGROUND OF INVENTION

The general art of utilizing a metal slug or billet and through various extrusion, cooling and heating steps forming mortar shells or projectiles is relatively old in the art.

Prior art methods have resulted in the production of mortar shells having a fragmentation count of only approximately 4000 particles. The fragmentation count is performed by the military establishment at a testing facility where a mortar shell is filled with an explosive as for actual field use. The shell is exploded under controlled conditions where all of the particles are retrieved, sized and counted. Such count of 4000 particles has been the accepted standard in the production of mortar shells in the past.

The steel ordinarily used for these prior art shells has been AISI (American Iron and Steel Institute) 1340 and 1040 grades. The AISI 1340 grade has a carbon content in the range of 0.38% to 0.43%, and manganese content in the range of 1.60% to 1.90%. The AISI 1040 grade, a very inexpensive steel, has a carbon content in the range of 0.37% to 0.44%, and manganese content in the range of 0.60% to 0.90%.

The steel industry through the AISI has classified the 1340 grade of steel as an "alloy steel" because of the high content of manganese, normally over 1%. As for the 1040 grade, the AISI classifies this steel as simply "carbon steel".

Additionally, both steels, i.e. 1340 and 1040 are referred to in the industry as "hypoeutectoid steels". These are steels with carbon content below approximately 0.80%. Steels with carbon content above approximately 0.80% are referred to as "hypereutectoid steels." See "Metallurgy For Engineers", Second Edition, 1962, O. Van Nostrand Company, Inc., New Jersey for definitions of eutectoid steels.

In fabricating prior art mortar shells with the accepted standard of particle fragmentation characteristics, the practice has been to cut slugs or billets from round bar or round corner square bar AISI 1340 steel, shot blast a slug, precoat it with lubricant, heat the slug in a furnace to approximately 1500° F., or 2150° F., introduce it while hot into a two cavity die and punch assembly wherein the slug is converted first into a preshape in a form somewhat like a bullet, then into an extrusion having the general form of an elongated hollow cup open at one end. Numerous cold steps follow, including further drawing, machining, ironing and shaping, then stress relieving with conventional preparatory and finishing operations in order to complete the shell.

For an 81 millimeter shell, as an illustration, the AISI 1340 steel slug is approximately 3 inches in diameter, 3-11/16" long, weighing slightly over 7 lbs. This eventuates into a tapered shell about 10 inches long with a maximum O.D. slightly over 3 inches and with a wall thickness of about 0.222" throughout most of its length, with variations at both ends. The general shape is illustrated in FIG. 2. A shell thus manufactured by the above procedures has a fragmentation of about 4,000, that is, upon explosion, disintegrates into about 4,000 particles of steel.

However, with the advent of changes in warfare and terrain, the possible need for a mortar shell possessing the characteristics of a greater number of particles upon fragmentation has developed. With such an increased count, the effectiveness of the shell would be toward the wounding of a greater number of military personnel in certain types of terrain.

The major problem encountered in endeavoring to increase fragmentation while using a steel such as AISI 1340 or 1040, is that being hypoeutectoid an increased fragmentation cannot be produced without expensive hardening operations or the use of complex engraved internal patterns as mechanical aids to fragmentation.

This has been recognized by Paul J. Horvath, Jr., a leading authority in the production and uses of steel. In his U.S. Pat. No. 3,547,032 he states as follows:

"Shell bodies manufactured from hypoeutectoid steels are generally too ductile to provide good fragmentation characteristics", In the above patent, Mr. Horvath only utilizes hypereutectoid steels because all of his examples as well as his claim call for carbon over 1.00%.

Thus, heretofore, the production of a shell with increased fragmentation capabilities has been practically unobtainable when using a hypoeutectoid steel such AISI 1040 or 1340.

SUMMARY OF THE INVENTION

It is an object of this invention to utilize a method during the initial stages of the shell formation wherein additional steps are involved to change the microstructure of hypoeutectoid steel, which when cold formed thereafter will increase the fragmentation count or shattering characteristics of the steel by detonation of explosive material within said shell.

Further, it is an object of this invention to process a mortar shell or other projectile of high fragmentation characteristics from carbon or alloy steel which contains carbon of less than 0.80% and thus to lessen the cost of the product below that of shells produced from a steel such as HF-1 which is shown in the prior art Horvath U.S. Pat. No. 3,547,032.

Another object is to utilize carbon steel or alloy steel i.e. AISI 1040 or 1340 respectively, with an intermediate processing step of spheroidizing followed by severe geometric shape changes by cold forming to increase the shattering characteristic of the hypoeutectoid steel by detonation of explosive material within said shell.

Additional objects of the present invention reside in the specific construction of the mortar shells or other explosive projectiles particularly described in the specification as shown in the drawings.

As an illustration, the external form and dimensions of a mortar shell produced by our method, is the same as previously described. Many of the same steps are performed. The difference in the product is a microstructure change in the hypoeutectoid steel achieved by an intermediate heating and cooling step followed by said cold working of the product which results in a shell having a fragmentation, depending upon which grade of steel, from 5,000 to about 7,000 particles determined from tests. The effectiveness is thus very substantially increased. A further advantage realized is that a cheaper steel, AISI 1040 can be used for the starting material.

The crux of the invention in the method is a heating and cooling of the hypoeutectoid steel partially worked shell at an intermediate stage, preferably after the extrusion is formed, which is then followed by cold coining, ironing or forming by punches and dies to produce greater shattering characteristics of the steel when the shell is finished by machining, capping, painting and drying of the shell and there is detonation of explosive material within the shell.

PREFERRED EMBODIMENT OF THE INVENTION

Figure 1:
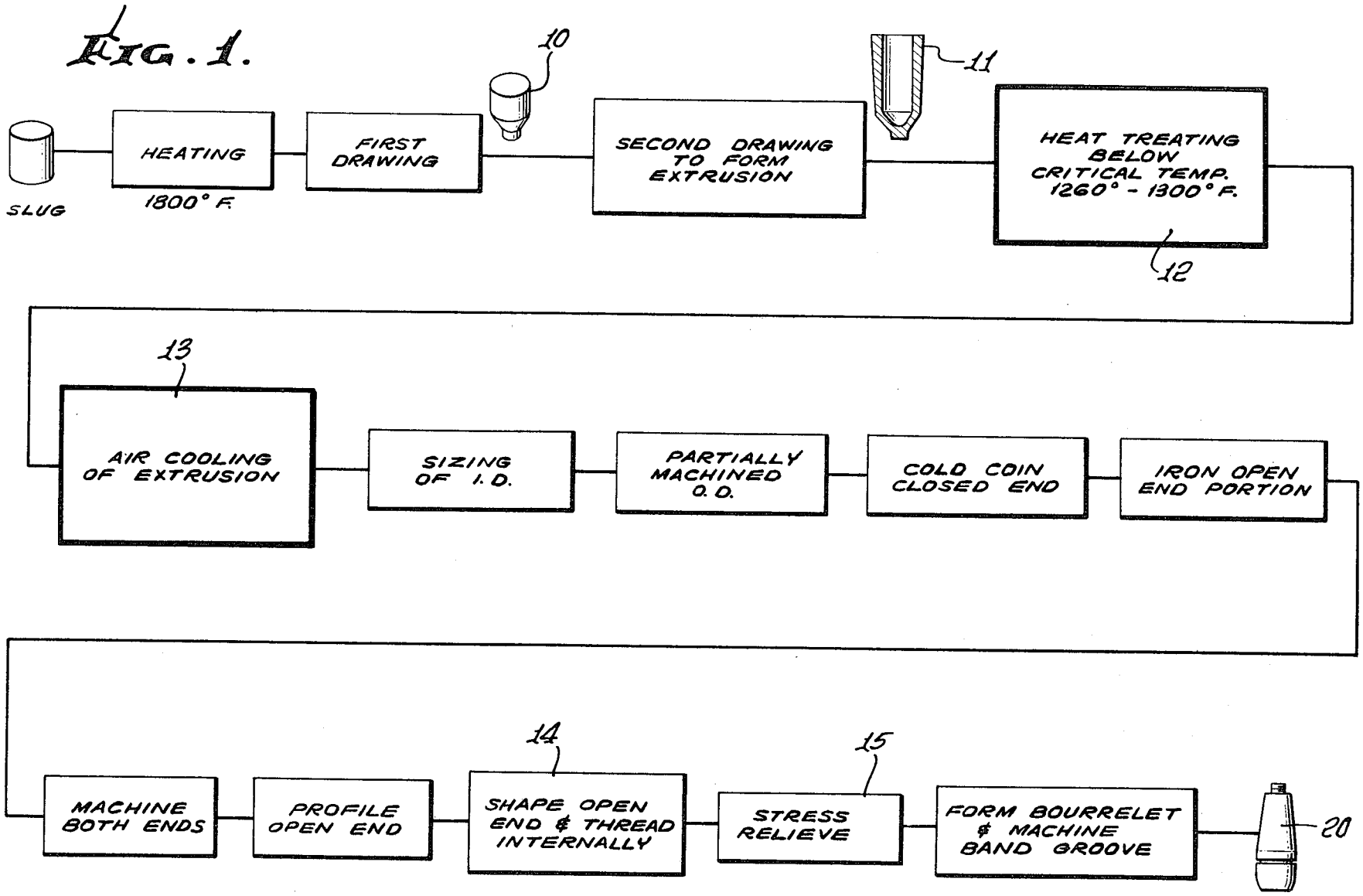
FIG. 1 is a flow sheet illustrating in graphic form the steps including new steps to produce the improved ordnance or mortar shell.
Figure 2:
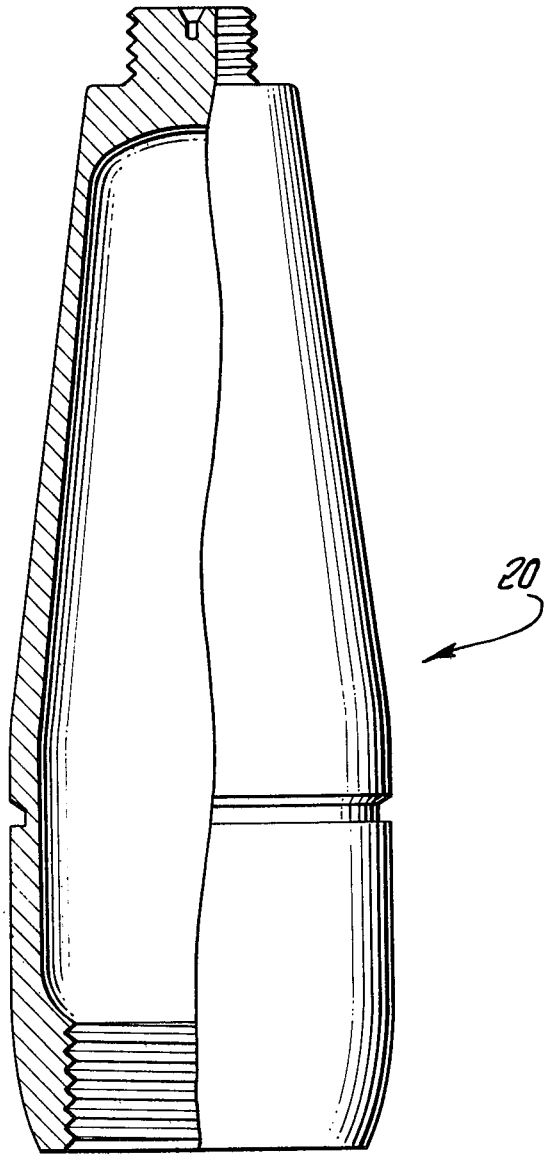
FIG. 2 is a plan view partly in section of a completed 81 mm. mortar shell formed by the method of this invention ready for final fittings and explosive.

It is well known that steel in the as-forged or as-rolled condition consists of ferrite and carbide in mixtures that vary in the composition of the steel and other factors, and that manganese and other additives may be included. Generally, for purposes of this application, we are concerned with two types of steel known and recognized by the American Iron and Steel Institute as AISI 1040 carbon steel and AISI 1340 alloy steel which were employed. However, other types of carbon and alloy steels may be employed with equal results and still not depart from the spirit of the invention.

The percentage of carbon in these respective steels are well known in the industry and are also set forth in the forepart of this specification. Each of these steels are hypoeutectoid steels because each contain less than 0.80% of carbon.

Such steel structures can be completely converted to austenite by heating at or above the upper critical temperature. When a higher heat (above the upper critical) is employed and the steel is slowly cooled, the hypoeutectoid steel will have a structure in which the iron carbides will be lamellar, whereas at temperatures closer to the recognized lower critical which is approximately 1330° F. the the steel, if slowly cooled, will have a structure in which the iron carbides will be spheroidal.

By way of illustration and not limitation we have used both AISI 1040 carbon and AISI 1340 alloy steel to form the ordnance shells.

The procedure is to select the billet which is heated to a temperature of about 1800° F., which is a high heat. A two stage forging is made while the billet remains hot to form a cup.

Cooling the cup down to room temperature produces annealing, and the resulting structure is generally lamellar.

Heretofore, in the process practiced in forming ordnance or mortar shells, the forming steps succeeding the hot-cup drawing have been performed cold, that is at room temperature. No further annealing or treatment for altering the structure of the steel has been employed. The only heating has been a stress relieving step utilizing a heat in the range of 500° F. to 1000° F. for a period of 30 minutes to one hour, which does not make any appreciable change in the lamellar nature of the steel.

We have discovered that the end product, an ordnance or mortar shell, will have a higher fragmentation count if the hypoeutectoid steel structure is spheroidal rather than lamellar, when additionally subsequently cold worked to severely change the shape of the cooled cup.

To that end, and without sacrificing the benefit of a high heat preparatory step for the hot-cup two stage draw, we have introduced a procedure for microstructure conversion of the lamellar to spheroidal, succeeding the hot-cup draw. It has been found that a minimum 60% spheroidization of the hypoeutectoid steel is sufficient for the intended purpose. Not only is the end product improved for the purpose intended, but the cold forming steps are much easier to accomplish. This procedure is set forth at the appropriate point in the more detailed description which follows.

After cutting slugs from a hypoeutectoid steel bar, they are hot blasted and given a precoat of lubricant such as colloidal graphite in water.

Figure 3:
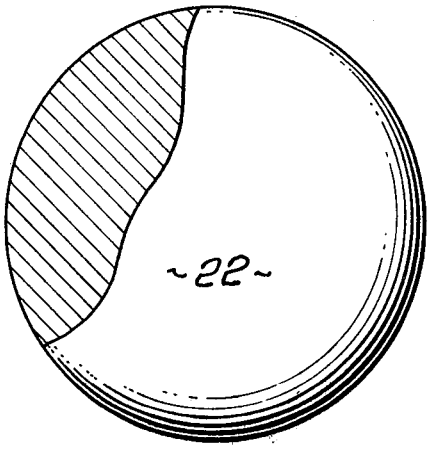
FIG. 3 is an illustration of modified form of steel slug from which the mortar shell is formed.

FIG. 3 illustrates a ball of steel 22 which shows a modified form of slug to use in forming the finished shell.

The slugs are then heated in an induction furnace for about three (3) minutes to approximately 1800° F., and while hot are subjected to a two stage forging operation in a die and punch. The first tool shapes the slug into a form 10 resembling a snub-nosed bullet, and the second operation forms an elongated cup 11 usually referred to an as extrusion.

The extrusions are air cooled to about 300° F.

The next procedure is critical, the parameters must be carefully observed, dependent upon the types of steel used and we believe it to be novel in the fabrication of shells and to accomplish our objective, when coupled with subjecting the shells to at least 25% cold working thereafter.

The extrusions are subjected to prolonged heating in a furnace, indicated at 12 in the drawing, at a temperature slightly below the critical. The time may range from twelve to twenty-four (12–24) hours, dependent upon whether carbon or alloy hypoeutectoid steels are used. Best results are obtained in the upper range. The temperature should be maintained slightly below the lower critical of the steel. The lower critical of these steels is about 1330° F., and the temperature for this treatment should be 1285° F.±20° F. Otherwise stated, the range employed may be approximately 1265° F., to 1305° F., when a carbon or alloy steel is used. However, the temperatures and times may vary depending upon the type of steel used. The main objective is to heat the steel whereby a minimum of 60% of the iron carbide of the microstructure is converted to the spheroidal character.

At the end of the heating period the furnace heat is turned off and the extrusions or cups are left in the furnace to slowly cool down to approximately 850° F. to 900° F.

They are then removed from the furnace and cooled in ambient air to room temperature as indicated at 13.

This produces spheroidized structure of globular iron carbides in a ferritic matrix, the primary objective being to increase shattering capabilities upon explosion when the elongated cup is further formed by cold forming operations into a complete ordnance shell. It has been found that cold working of at least 25% after spheroidizing will achieve the desired result. However, it must be recognized that cold working the steel to a greater extent will also produce the desired shattering characteristics. The percentage of cold working refers to the geometric shape or change induced into the spheroidized cup by ironing, coining, etc.

It has been found that if the heating should be elevated to the upper critical or above and conventional quenching be used to rapidly cool the steel, the austenite which formed during the heating portion of the cycle would be converted to martensite in the quenching operation obviously producing a microstructure different from spheroidizing. While such a process might produce some improvement in fragmentation over present methods, it would result in a considerable increase in cost due to the more expensive thermal treatment and quenching and the considerably greater thermal treatment and quenching and the considerably greater difficulties in machining the end product that would result. In all probability this approach would not result in as great a fragmentation improvement as has been demonstrated can be obtained by the application of this invention.

We are aware that spheroidizing steel is well known, particularly for improvement in subsequent cold forming and machining operations. However it has never been recognized as a desirable operation in the manufacture of shells for the specific purpose of improving fragmentation. We believe our parameters, including the stage at which they are introduced, to be not only novel, but they are important to the end product. Moreover, we believe that we are the first to discover that a casing such as a mortar shell, produced by our method, including cold forming thereafter will explode with a very much higher fragmentation than prior shells in which the steel remained in a "pearlitic" condition.

The principal remaining steps of cold working including coining and ironing as well as machining and shaping, diagrammatically illustrated in the drawing, are performed with the workpiece or spheroidized cup at room temperature, and are well known to the art. Such coining steps include the utilization of punches and dies to accomplish severe geometric shape changes. For the ironing steps punches and dies are used to materially reduce the straight wall thickness of the shell. The practice includes lubrication and washing at various intervals in the cold working.

The only time heat is applied subsequent to the spheroidizing operation is near the end of the fabrication, preferably after the shaping of the open end, performed at Station 14. This is only for stress relieving done at Station 15.

The almost finished shell may be subjected to a temperature in the range of 500° F. to 1000° F., for about thirty (30) minutes to an hour. We have found the optimum, under conditions previously described, to about 700° F., for about thirty (30) minutes. The stress relieving does not alter the spheroidal character of the hypoeutectoid steel, and the final shell 20 continues to possess the latter characteristics.

The invention and its attendant advantages will be understood from the following description and it will be apparent that various changes may be made without departing from the spirit and scope thereof.

What we claim:

1. In a hot-cup cold forming method of producing an ordnance shell having a capability of forming a high volume of small fragments from a hypoeutectoid steel billet wherein the billet is heated to approximately 1800° F., reducing the yield strength of said billet and increasing ductility thereof, and forming a cup therefrom while hot, thereafter slowly air cooling said cup to ambient temperature leaving a cooled cup and then performing subsequent intermediate shape forming operations cold followed by finishing steps to complete said shell, the improvement which comprises the intermediate steps following the forming of said cooled cup and prior to the finishing steps of:

heating said cooled cup to a temperature for a period of time whereby the iron carbide constituent of the microstructure of said hypoeutectoid steel is converted form a lamellar to a spheroidal character sufficient to produce a minimum of 60% spheroidization of said hypoeutectoid steel;

slowly air cooling said cup to a reduced temperature;

exposing said cup to ambient temperature and air cooling to room temperature thereby forming a cup with a spheroidized structure;

subsequently cold coining said spheroidized cup by cold working the same between a punch and die to severely change the geometric shape and wall thickness approximating the finished shell; and cold ironing the wall of said shell between a punch and die to materially reduce the wall thickness of said shell to further approximate said finished ordnance shell, wherein said intermediate steps together renders said shell capable of said high volume of small fragmentation with the detonation of explosive material within said shell.

2. A method as defined in claim 1 wherein the subsequently forming step includes, deforming while cold the microstructure of substantially all of said hypoeutectoid steel by subjecting it to at least 25% cold working.

3. A method as defined in claim 1 wherein the hypoeutectoid steel billet is alloy steel of the grade known as AISI 1340; and the heating of said cooled cup to a temperature in a range of 1260° F. to 1330° F., for a period of time between 12 and 24 hours will produce said minimum of 60% spheroidization.

4. An ordnance shell having high susceptibility of shattering by detonation of explosive material within said shell as manufactured according to the steps of claim 1.

5. An ordnance shell having high susceptibility of shattering by detonation of explosive material within said shell as manufactured according to the steps of claim 2.

* * * * *

UNITED STATES PATENT AND TRADEMARK OFFICE

CERTIFICATE OF CORRECTION

PATENT NO. : 4,246,844

DATED : 27 January 1981

INVENTOR(S) : Joseph M. Segmiller and Thomas E. Lewis

It is certified that error appears in the above—identified patent and that said Letters Patent is hereby corrected as shown below:

On the title page, Item [73] should read:

--Norris Industries, Inc.--

Column 1 above line 5 "BACKGROUND OF INVENTION" insert

--GOVERNMENTAL INTEREST
The invention described herein may be practiced by or for the Government without the payment of any royalty thereon.--

Signed and Sealed this

*Twentieth* Day of *October 1981*

[SEAL]

*Attest:*

GERALD J. MOSSINGHOFF

*Attesting Officer*

*Commissioner of Patents and Trademarks*